US005664054A

United States Patent [19]

Su

[11] Patent Number: 5,664,054

[45] Date of Patent: Sep. 2, 1997

[54] SPIKE CODE-EXCITED LINEAR PREDICTION

[75] Inventor: Huan-Yu Su, San Clemente, Calif.

[73] Assignee: Rockwell International Corporation, Newport Beach, Calif.

[21] Appl. No.: 536,329

[22] Filed: Sep. 29, 1995

[51] Int. Cl.[6] ..... G10L 9/04

[52] U.S. Cl. ..... 704/219; 704/208; 704/223

[58] Field of Search ..... 395/2.17, 2.28, 395/2.32

[56] References Cited

U.S. PATENT DOCUMENTS 5,119,424 6/1992 Asakawa et al. ..... 395/2.17
5,233,660 8/1993 Chen ..... 395/2.17

OTHER PUBLICATIONS

Allen Gersho, "Advances in Speech and Audio Compression", Proc. IEEE, vol. 82, No. 6, pp. 900–918 Jun. 1994.
Andreas S. Spanias, "Speech Coding: A Tutorial Review", Proc. IEEE, vol. 82, No. 10, pp. 1541–1582 Oct. 1994.

*Primary Examiner*—Allen R. MacDonald
*Assistant Examiner*—Tālivaldis Ivars Šmits
*Attorney, Agent, or Firm*—William C. Cray; Susie H. Oh

[57] ABSTRACT

A conventional CELP speech codec synthesizes a pitch interval in a sound by synthesizing a scaled innovation signal—typically, a random signal—and adding it to a scaled pitch signal derived from the synthesized speech of the previous pitch interval. This invention continues this practice when it is advantageous, but, at the onset of the sound or whenever else needed, replaces the scaled innovation signal with a scaled spike signal. This is done since a spike is sometimes more useful than an innovation signal is, innovation signals being by definition crafted to instead represent differences between adjacent pitch intervals within a sound rather than at the onset of a sound.

4 Claims, 5 Drawing Sheets

SPIKE CODE-EXCITED LINEAR PREDICTION

BACKGROUND OF THE INVENTION

This invention relates to speech compression using code-excited linear prediction (CELP), and has particular relation to CELP speech compression which uses a low bit rate.

CELP speech compression exploits the fact that, in the time domain, the human vocal tract produces a sequence of sounds, and that each sound is easily divided into a sequence of very similar pitch intervals. A CELP codec compresses and reconstructs each pitch interval in a two step process: pitch prediction evaluation and innovation signal search.

The pitch prediction evaluation step exploits a characteristic of all pitch intervals: for each pitch interval of the sound, taken at its fundamental pitch, the instantaneous normalized amplitude correlates closely with the instantaneous normalized amplitude at the same part of the previous pitch interval. Normalization means multiplying by some scale factor, and time shifting by some lag (or lead) factor. The instantaneous amplitude of the previous pitch interval is known, or can be synthesized with satisfactory fidelity. Therefore, the instantaneous amplitude of the current pitch interval can be synthesized with satisfactory fidelity even if only the scale and lag factors are known.

In the innovation signal search step, a search is made among a collection of signals, called innovation signals, for the best signal. The library of innovation signals is generally totally random. For each pitch interval of the sound, the innovation signal is selected which most closely approximates, moment to moment, a typical difference between the normalized amplitude of one pitch interval and the normalized amplitude of the previous pitch interval. The innovation signals are therefore inherently normalized. A suitable scale factor by which the innovation signal is to be multiplied must be established. It is often not necessary to further establish a lag factor for the innovation signal, but one can be provided if desired.

The scale and lag factors from the pitch prediction step, and the scale factor and innovation signal from the innovation signal search step, could be transmitted on a telephone line directly. They similarly could be directly recorded on a tape or other recording medium directly; "transmit," as used herein, therefore includes "record," and "receive" therefore includes "play back." Regardless of whether transmission or recording is contemplated, however, direct transmission can be improved upon by coding. Each scale factor is coded in such a fashion that all scale factors in a particular range bin of scale factors are given a single code. A different code is provided for each range. Ranges of pitch lags are similarly coded. Selecting range boundaries may be done in any manner which the worker finds convenient. Good results may be obtained by selecting range boundaries which result in each code being transmitted about as often as any other code is transmitted.

A code is also transmitted indicating which innovation signal was selected. The collection or library of innovation signals therefore forms a codebook, and the "innovation signal search step" is therefore often called the "innovation codebook search step".

The codes may be transmitted using analog technology, but digital transmission is preferred.

At the receiving (or playback) end, CELP processing takes the innovation signal code and reverses it to produce the innovation signal. It takes the innovation scale factor code and reverses it to produce the innovation scale factor. It multiplies the innovation signal by the innovation scale factor to produce a synthesized scaled innovation signal. It takes the overall synthesized signal of the previous pitch interval, lags it by the pitch lag (reversed from the pitch lag code), and multiplies the result by the pitch scale factor (reversed from the pitch scale factor code) to produce a synthesized pitch signal. The synthesized pitch signal and the synthesized scaled innovation signal are added together to form the overall synthesized signal of the current pitch interval. This overall synthesized signal is applied to a linear predictive coding (LPC) synthesis filter. The coefficients of the LPC synthesis filter are adaptively selected at the transmitting (or recording) end, as is known in the art. These coefficients are coded, and the coefficient codes are transmitted with the other codes. The process is then repeated with the next set of codes: LPC filter coefficients, pitch lag, pitch scale factor, innovation index, and innovation scale factor.

At the transmitting (or recording) end, an approximate set of these five codes is selected, and the incoming actual speech is compared with speech from the synthesized signal produced from these five codes. The codes are then adaptively modified until the difference between the actual incoming speech and the speech from the synthesized signal (as determined by a perceptual weighting filter) reaches a minimum. The codes which produce this minimum difference are then transmitted (or recorded) to the receiving (or playback) end.

The foregoing CELP process produces synthesized speech which is perceived by the human ear as intelligible, but not of high fidelity. Additional bits can be devoted to any or all of the five codes to obtain additional fidelity, but such bandwidth is expensive and not always available. What is needed is a way to get improved fidelity, as perceived by the human ear, without requiring additional bit bandwidth.

SUMMARY OF THE INVENTION

The present invention provides improved perceived fidelity, without additional bit bandwidth, by exploiting the tautology that predicting a signal is possible only if the signal is predictable. Applicant has exploited this tautology by discovering a fundamental difference between the interior of a sound and the onset of the same sound. Once the sound is well under way, a subsequent pitch interval is reasonably predictable from the previous pitch interval. Before the onset of a sound, however, all that is available is white noise, or, worse, a pitch interval from in entirely different sound. These are not useful for predicting the first pitch interval of the new sound.

The innovation signals, described in the "Background of the Invention", could be used to predict the first pitch interval, but they do an inadequate job. They were, after all, carefully crafted to express typical differences between adjoining pitch intervals (after normalization for scale factor and lag) within the sound. They were not crafted to express typical differences between the (normalized) signal in the first pitch interval of the sound and the (normalized) white noise in the equivalent length of time immediately preceding the sound. It will not do, as a first step in the prediction process, to add a conventional innovation signal to the white noise. Some other first step in the prediction process must be used to predict the first pitch interval.

Applicant has discovered that this may be done by replacing the conventional innovation signal with a spike. In the digital domain, this is expressed by a plus one followed by a minus one, or a plus two followed by two minus ones, or some similar pulse train. Applicant therefore provides a codebook of normalized spikes, each ready to be multiplied by a suitable scale factor (also coded). The best scaled spike is compared with the putative onset pitch interval, and the best scaled innovation signal (from the innovation codebook) is also compared with the putative onset pitch interval. If the scaled spike is the closer match, then an indication is transmitted that an onset pitch interval has been encountered, and that the code is from the spike codebook rather than the innovation codebook. Subsequent codes are sent from the innovation codebook.

The foregoing description contemplates that, within the sound, only the immediately preceding pitch interval is used as a base for predicting the current pitch interval. If desired, the best combination of several preceding pitch intervals may be used, and the term "pitch interval," as used herein, therefore includes "combination of pitch intervals" as appropriate. This adds to the complexity of the system but, importantly, does not add to the bit rate. Likewise, when determining whether a pitch interval is an onset pitch interval or an interior pitch interval, it is not necessary to consider only the putative onset pitch interval. Several pitch intervals of synthesized speech may be compared with the corresponding pitch intervals of actual incoming speech. The best scaled spike (if any) and, indeed, the best onset pitch interval (if any), may then be selected. A well selected scaled spike at a well selected onset pitch interval has a beneficial effect across the entire sound, and not just at its onset.

Spikes, rather than the previous pitch interval, are commonly used as templates during the first pitch interval of a sound, when the previous pitch interval is usually little more than white noise. However, it also occasionally happens that the spike is a good approximation of the difference between two pitch intervals within a sound; indeed, it may be a better approximation than any of the innovation signals. It adds very little to the bit rate to send a code for a spike rather than for an innovation signal, especially since there is no way to determine when the next sound will start and a spike will be, in effect, a necessity. Indeed, rather than forcing the apparatus to make the academic determination of whether a new sound has begun, it is both easier and more effective to simply ask whether the best approximation to the pitch interval at hand is a spike or a more conventional innovation signal.

The foregoing description contemplates that the spike codebook and the innovation codebook are of equal size, and that some indicator bit is used to toggle between them. Preferably, however, the spike codebook is smaller, and the spike codebook and innovation codebook are merged into a single codebook. A single apparatus may then be used to apply gain and lag adjustments.

If a single codebook is used, the relative sizes of the spike portion and the innovation portion must be selected to maximize perceived fidelity. It will not do to say that the spike portion and the innovation portion must have equal sizes, and that one bit of the code must therefore be used to toggle between them. However, it also will not do to say that interior pitch intervals are much more frequent than onset pitch intervals, and that therefore the innovation portion must be much larger than the spike portion. This effectively eliminates spike coding. A trade-off must be made between their relative sizes. This can be done on a fixed basis or on an adaptive basis.

If desired, codes from both the spike codebook (or portion) and the innovation codebook (or portion) can be sent for every pitch interval. This is not preferred for low bit rate applications, since it greatly increases the bit rate with only a modest increase in perceived fidelity. It may be desirable in moderate to high bit rate applications.

DETAILED DESCRIPTION OF THE DRAWINGS

Figure 1:
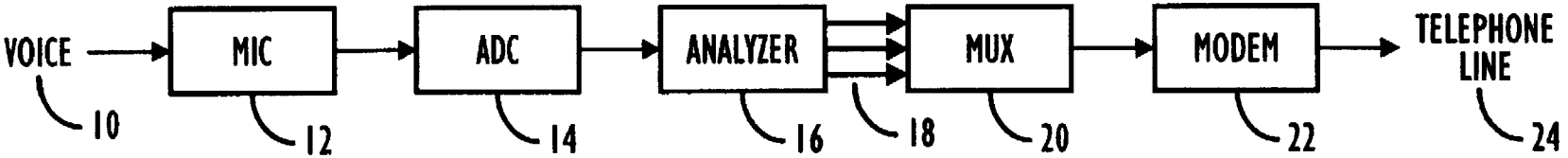
FIG. 1 PRIOR ART
FIG. 1 is a block view of a prior art transmitter, or recorder, using CELP.

In FIG. 1, a voice 10 is applied to a microphone 12, the output of which is digitized by a analog-to-digital converter (ADC) 14. The digitized voice from the ADC 14 is applied to an analyzer 16, which produces a plurality of codes 18. The codes 18 are multiplexed by a multiplexer (MUX) 20, the output of which is modulated by a modem 22, the output of which is connected to a telephone line 24. An analog voice is now being transmitted as a digital telephone signal.

Figure 2:
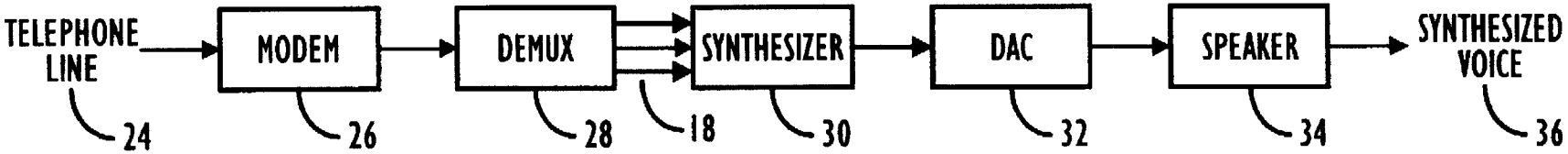
FIG. 2 PRIOR ART
FIG. 2 is a block view of a prior art receiver, or playback device, using CELP.

In FIG. 2, a digital signal on the telephone line 24 is demodulated by the modem 24. A demultiplexer (DEMUX) 28 demultiplexes the demodulated signal into its component plurality of codes 18. The codes 18 drive a synthesizer 30 to synthesize a digital reproduction of the original voice 10. The digital reproduction is applied to a digital-to-analog converter (DAC) 32, which drives a speaker 34 which produces a synthesized voice 36 which is quite close to the original voice 10.

Figure 3:
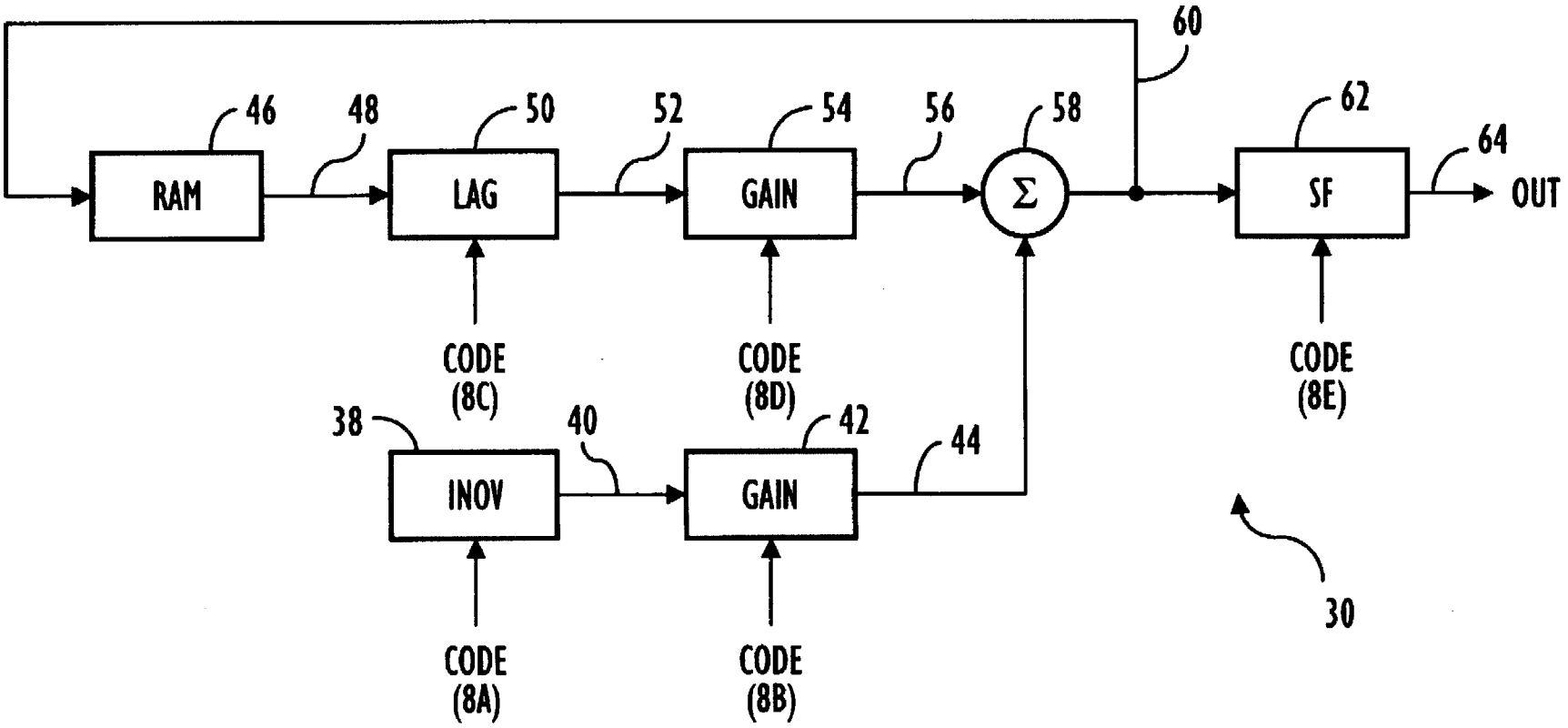
FIG. 3 PRIOR ART
FIG. 3 is a block view of a prior art synthesizer used in the apparatus of FIG. 2.

FIG. 3 shows the synthesizer 30 used by the prior art. The codes 18 shown in FIGS. 1 and 2 are specified as codes 18A through 18E for ease of identification. An innovation signal code 18A drives an innovation signal codebook 38, which reproduces and outputs an innovation signal 40. An innovation scale factor code 18B drives a gain, or scale factor, element 42 which reproduces an innovation scale factor and multiplies it by the innovation signal 40 to produce a scaled innovation signal 44.

While the scaled innovation signal 44 is being reproduced, a memory 46 is outputting an overall synthesized signal 48, which it has stored from the previous pitch interval. The memory 46 must be able to be quickly written to or read from. A random access memory (RAM) or first-in-first-out memory (FIFO) is preferred. A lag element 50 receives the previous overall synthesized signal 48, lags (or leads) it by a factor which it reproduces from a lag factor code 18C, and outputs a lagged pitch signal 52. The lagged pitch signal 52 is applied to a pitch scale factor, or gain, unit 54, which multiplies it by a pitch scale factor which it reproduces from a pitch scale factor code 18D. The pitch gain unit 54 outputs a scaled pitch signal 56, which is applied to a summer 58. The summer 58 also receives the scaled innovation signal 44, and outputs the sum 60 to the RAM 46 as the new overall synthesized signal. If desired, the lag element 50 and gain element 54 may be reversed.

The sum 60 is also applied to a synthesis filter (SF) 62. The SF 62 includes apparatus to receive LPC codes 18E, decode them into tap weights, and apply the tap weights to the SF 62 proper. The SF 62 produces the overall output signal 64 of the synthesizer 30.

Figure 4:
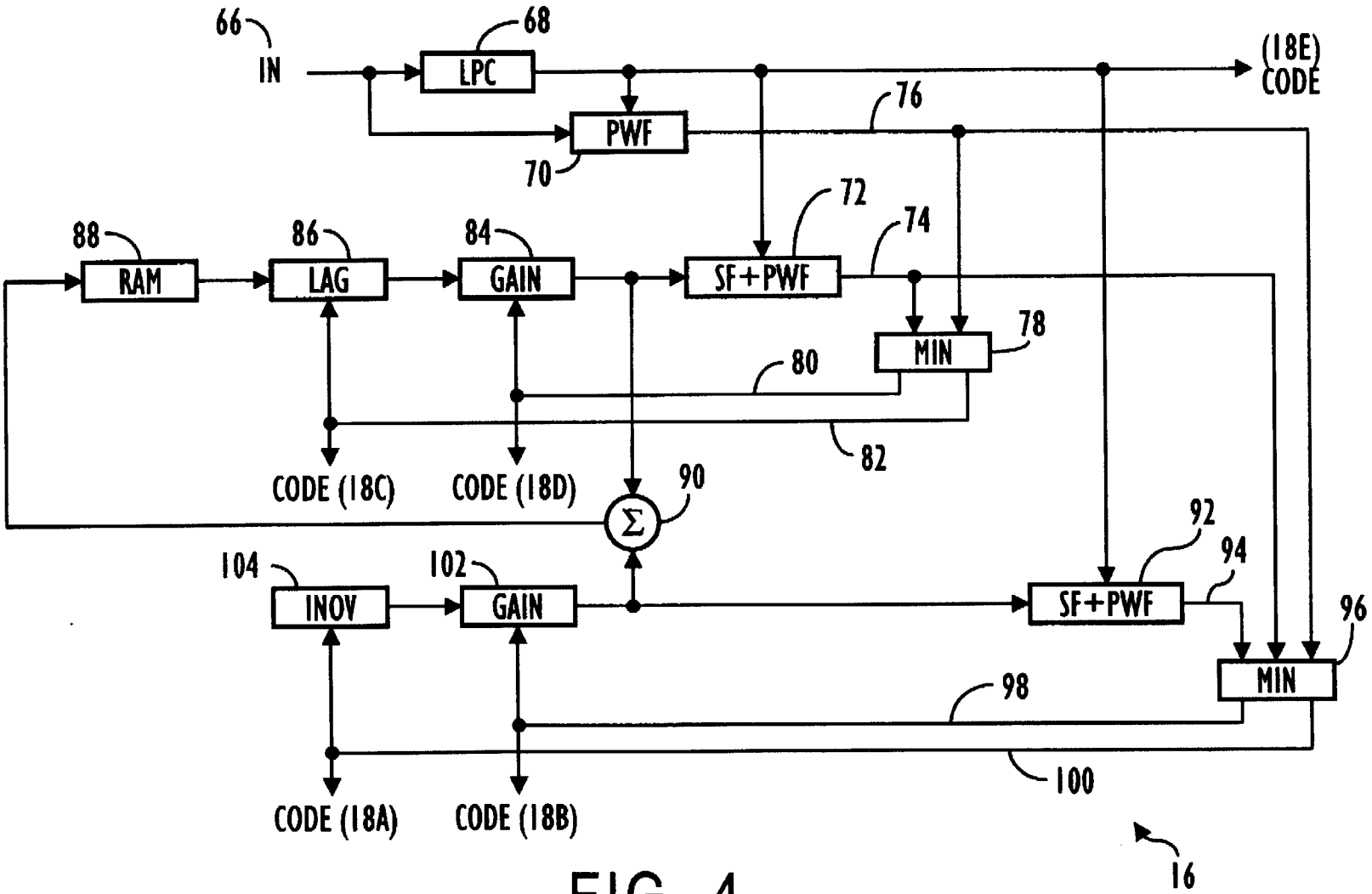
FIG. 4 PRIOR ART
FIG. 4 is a block view of a prior art analyzer using a two step parameter extraction procedure to generate the parameters used to operate the apparatus shown in FIG. 1.

FIG. 4 shows the prior art method of producing the codes 18 in an analyzer 16. The codes 18 may be a series of scalar quantization (SQ) indices, or a single vector quantization (VQ) index, all as is known in the art. Digitized input speech 66 is applied both to a linear prediction analysis and coding (LPC) device 68 and to a perceptual weighting filter (PWF) 70. The LPC device 68 breaks the digitized speech into frames, and then takes each frame through a conventional process of linear prediction analysis and coding. One of the SQ indices, or one of the components of the VQ index, is an LPC code 18E, which sets the tap weights of the PWF 70 and thereby allows the PWF 70 to produce a digitized signal as it would be perceived by a human being, all as is known in the art.

The LPC code 18E is also applied to, and provides tap weights for, a first (pitch) synthesis filter and perceptual weighting filter (SF&PWF) 72, the output 74 of which is combined with the output 76 of the PWF 70 in a pitch minimizer 78. The pitch minimizer 78 produces two outputs, 80 and 82, which indirectly drive the SF&PWF 72, in such a fashion as to minimize the difference between the output 74 and the output 76; that is, the SF&PWF 72 is driven to emulate the PWF 70 as closely as possible. The output 80 is the pitch scale factor code 18D, and is applied to a gain element 84. The output 82 is the pitch lag code 18C, and is applied to a lag element 86. The lag element 86 drives the gain element 84, and is driven by a memory 88, which is, as before, preferably a RAM or FIFO. The RAM 88 holds an overall synthesized signal for one pitch interval, and is driven by a summer 90. The summer 90 receives the output of the pitch gain element 84 and the output of the innovation gain element, described below. As with the lag element 50 and gain element 54 of FIG. 3, it is possible to reverse the lag element 86 and gain element 84 of FIG. 4.

Operation of elements 72 through 90 in FIG. 4 is the same as the operation of elements 46 through 62 of FIG. 3. The only difference is that, in FIG. 3, the pitch lag code 18C and pitch gain code 18D are givens, while, in FIG. 4, they are byproducts of the effort of the minimizer 78 to drive the output of the SF&PWF 72 to match that of the PWF 70.

The LPC code 18E is further applied to set the tap weights of a second (innovation) SF&PWF 92, the output 94 of which is combined, in a second (innovation) minimizer 96, both with the output 76 of the PWF 70 and with the output 74 of the first SF&PWF 72. As was true of the first (pitch) minimizer 78, the second minimizer 96 produces two outputs, 98 and 100, which indirectly drive the second SF&PWF 92, in such a fashion as to minimize the difference between the output 94 and some combination of the outputs 74 and 76; that is, the second SF&PWF 92 is driven to emulate the combination of the PWF 70 and the first SF&PWF 72 as closely as possible. The output 98 is the innovation scale factor code 18B, and is applied to a innovation gain, or scale factor, element 102. The output 100 is the innovation signal code 18A, and is applied to a innovation signal codebook 104. The innovation signal codebook 104 drives the gain element 102.

Operation of elements 92 through 102 in FIG. 4 is the same as the operation of elements 38 through 44 of FIG. 3. The only difference is that, in FIG. 3, the innovation signal code 18A and innovation gain code 18B are givens, while, in FIG. 4, they are byproducts of the effort of the second minimizer 98 to drive the output of the second SF&PWF 92 to match that of the combination of the PWF 70 and the first SF&PWF 72.

Figure 5:
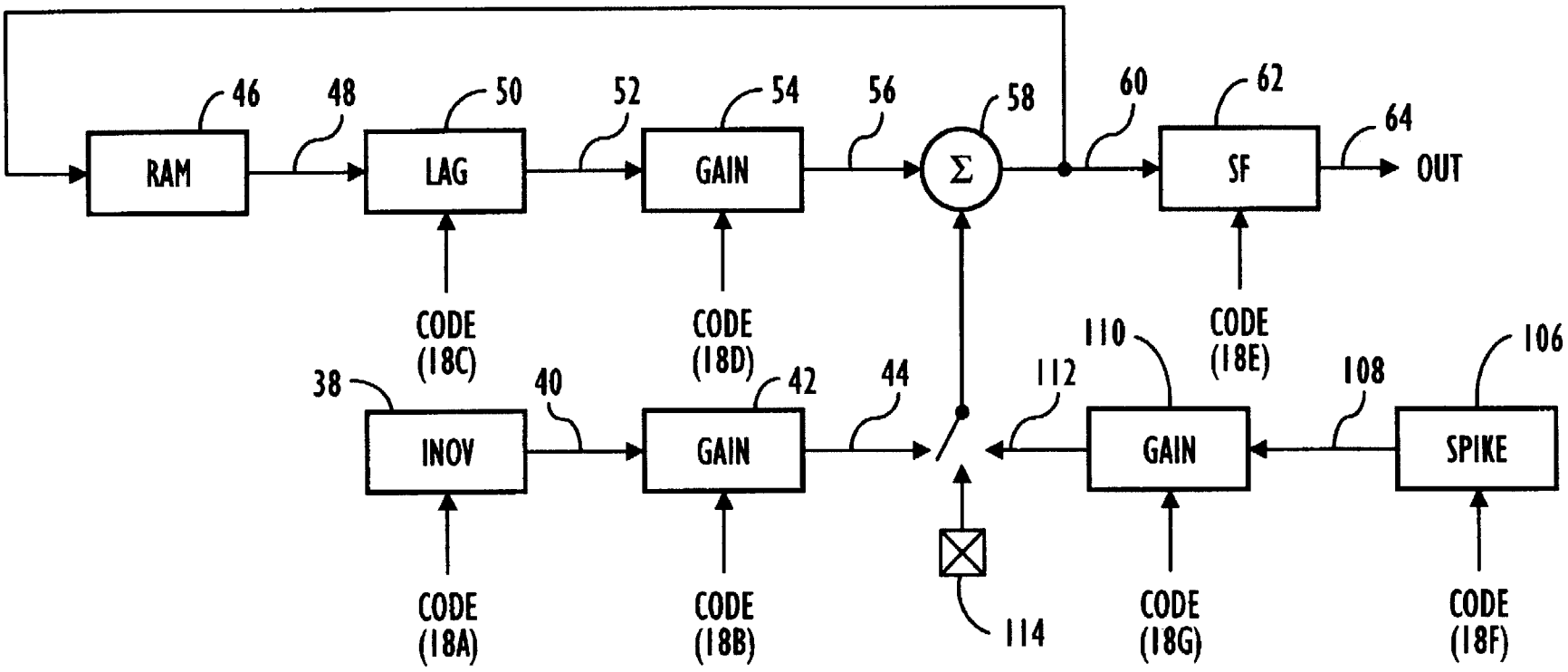
FIG. 5 is a block view of a synthesizer according to the present invention.

FIG. 5 shows an embodiment of the synthesizer 30 in the receiver portion of the present invention. It is identical to FIG. 3, except that there is the addition of a spike code 18F, which drives a spike codebook 106 to produce a spike signal 108. There is also added a spike gain code 18G, which drives a spike gain element 110 to reproduce a spike gain and multiply it by the spike signal 108 to produce a scaled spike signal 112. A selector switch 114 selects whether the scaled innovation signal 44 or the scaled spike signal 112 is to be applied to the summer 58.

Figure 6:
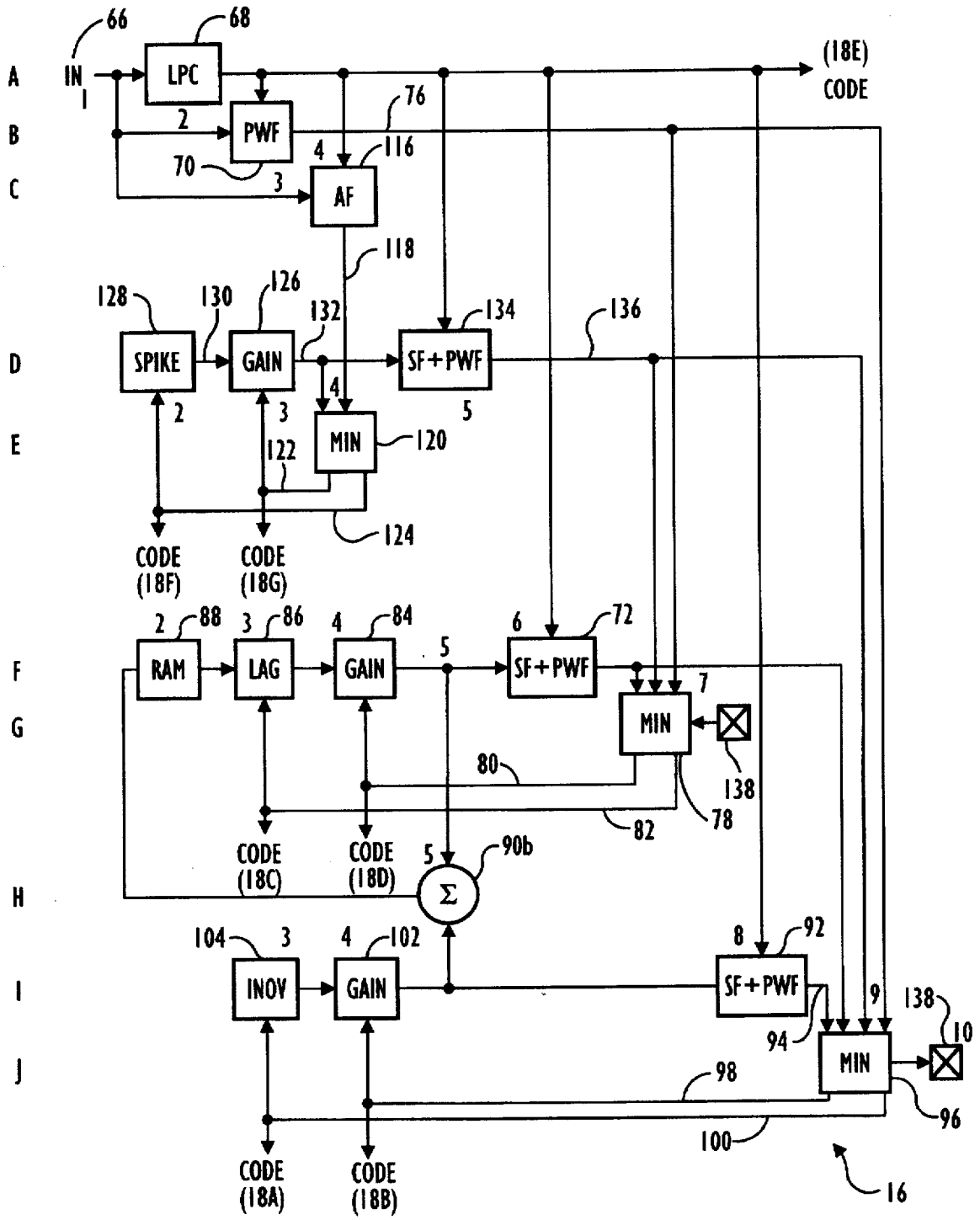
FIG. 6 is a block view of an analyzer according to the present invention.

FIG. 6 shows an embodiment of the analyzer 10 in the transmitter portion of the present invention. It is identical to FIG. 4, except that it shows additional apparatus for generating the spike signal code 18F, spike gain code 18G, and indicator code for the switch 114. In the present invention, the digitized input signal not only drives the LPC 68 and PWF 70; it also drives an LPC analysis filter (AF) 116 which, like the other filters, gets its tap weights from the LPC code 18E generated by the LPC 68. The output 118 of the AF 116 is an LPC residual signal, and drives a third minimizer, which (like the other minimizers) produces two outputs, 122 and 124. The output 122 drives a gain element 126 and the output 124 drives a spike codebook 128. The output 124 is the spike code 18F, and causes the spike codebook 128 to reproduce a spike signal 130. The output 122 is the spike gain code 18G, and causes the spike gain, or scale factor, element 126 to reproduce a spike gain, which it multiplies by the spike signal 130 to produce a scaled spike signal 132.

The third minimizer 120 seeks to minimize the difference between the scaled spike signal 132 and the output 118 of the AF 116. This is done in the LPC residual domain, before the scaled spike signal 118 is applied to a third SF&PWF 134. The first (pitch) minimizer 78 does its work after the signal passes through the first SF&PWF 72, just as the second (innovation) minimizer 96 does its work after the signal passes through the second SF&PWF 92.

The pitch minimizer 78 no longer drives the output of the first (pitch) SF&PWF 72 to emulate that of the PWF 70; it now must emulate some combination of the outputs of the PWF 70 and the third (spike) SF&PWF 134. Similarly, the innovation minimizer 96 no longer drives the Output of the second (innovation) SF&PWF 92 to emulate that of a combination of the PWF 70 and the first SF&PWF 72; it now must emulate some combination of the outputs of the PWF 70, the first SF&PWF 72, and the third SF&PWF 134.

The second (innovation) minimizer 96 is in the position to determine how well the outputs of the SF&PWFs 72, 92, and 134 match that of the PWF 70. The output of the pitch SF&PWF 72 must always be considered, but the choice on how to select between the innovation SF&PWF 92 and the spike SF&PWF 134 can be made on a pitch interval to pitch interval basis.

If the spike output 136 is more valuable than the innovation output 94 (that is, results in a closer match to the output 76 of the PWF 70), then the second minimizer 96 activates a control device 138 to tell the selector switch 114 (FIG. 5) to receive the spike output 112, and to tell the first minimizer 78 to consider the spike output 136. If the spike output 136 is less valuable than the innovation output 94, then the switch 114 is set to receive the innovation output 44, and the first minimizer 78 is set to disregard the spike signal 136 by receiving the same signal from control device 138.

As noted above, the RAM 88 in the transmitting analyzer shown in FIG. 6 may store the overall synthesized signal 48 from only the immediately preceding pitch interval, or it may store a combination of such overall synthesized signals 48 from several preceding pitch intervals. If the latter option is chosen, the RAM 88 includes additional apparatus for combining the overall synthesized signals 48 from the several preceding pitch intervals and for storing the combination. In this situation, the RAM 46 in the receiving synthesizer shown in FIG. 5 includes parallel additional apparatus for combining the overall synthesized signals 48 from the same several preceding pitch intervals and for storing the same combination.

SCOPE OF THE INVENTION

While an embodiment of my invention has been described in some detail, the true scope and spirit of my invention is not limited thereto, but is limited only by the appended claims, and their equivalents.

What I claim is:

1. A method for transmitting speech over a narrow bandwidth channel, the method comprising the steps of:

(a) converting speech from an analog auditory signal to an analog electronic signal;

(b) digitizing the electronic signal into digitized speech with an analog-to-digital converter;

(c) breaking the digitized speech into a plurality of frames;

(d) selecting a next frame and applying it to:

(1) a linear prediction coder to produce a plurality of tap weights and coding the tap weights to produce a tap weight code;

(2) a perceptual weighting filter set to the tap weights and constructed to produce, as an output, a digitized signal as it would be perceived by a human being; and (3) an analysis filter set to the tap weights and constructed to produce an LPC residual signal;

(e) receiving the output of the analysis filter at a first input of a spike minimizer, the spike minimizer producing:

(1) at a first output, a spike gain code which is applied to a spike gain element; and (2) at a second output, a spike signal code which is applied to a spike codebook; the spike gain element and the spike codebook being connected to jointly produce a scaled spike, the scaled spike being applied to a second input of the spike minimizer; and the spike minimizer generating a spike gain code and a spike signal code which minimize an error between the scaled spike and the analysis filter output;

(f) receiving the scaled spike at a spike synthesis filter and perceptual weighting filter set to the tap weights, the spike synthesis filter and perceptual weighting filter producing an output;

(g) receiving the output of the spike synthesis filter and perceptual weighting filter at a first input of a pitch minimizer, the pitch minimizer producing:

(1) at a first output, a pitch gain code which is applied to a pitch gain element; and (2) at a second output, a pitch lag code which is applied to a pitch lag element; the pitch gain element and the pitch lag being connected to jointly produce a scaled pitch signal from:

(A) the pitch gain code;

(B) the pitch lag code; and (C) a previous output of a memory; the scaled pitch signal being applied to a pitch synthesis filter and perceptual weighting filter set to the tap weights, and the pitch synthesis filter and perceptual weighting filter producing an output which is applied to a second input of the pitch minimizer;

(h) generating, in the pitch minimizer, a pitch gain code and a pitch lag code which minimizes an error between:

(1) the perceptual weighting filter output;

(2) the spike synthesis filter and perceptual weighting filter output; and (3) the pitch synthesis filter and perceptual weighting filter output;

(i) receiving the output of the pitch synthesis filter and perceptual weighting filter at a first input of an innovation minimizer, the innovation minimizer producing:

(1) at a first output, an innovation gain code which is applied to an innovation gain element; and (2) at a second output, an innovation signal code which is applied to an innovation codebook; the innovation gain element and the innovation codebook being connected to jointly produce a scaled innovation signal, the scaled innovation signal being applied to an innovation synthesis filter and perceptual weighting filter producing an output which is applied to a second input of the innovation minimizer;

(j) summing the scaled innovation signal with the scaled pitch signal in a summer to produce a scaled overall signal;

(k) storing the scaled overall signal in the memory;

(l) generating, in the innovation minimizer, an innovation gain code and an innovation signal code which minimize an error between:

(1) the perceptual weighting filter output;

(2) the spike synthesis filter and perceptual weighting filter output;

(3) the pitch synthesis filter and perceptual weighting filter output; and (4) the innovation synthesis filter and perceptual weighting filter output;

(m) generating, in the innovation minimizer, a control signal indicating whether or not a spike signal is to be used at a receiving end;

(n) applying the control signal to the pitch minimizer to cause it to use the spike synthesis filter and perceptual weighting filter output, but only if the control signal indicates that the spike signal is to be used at the receiving end;

(o) transmitting the tap weight code, the pitch gain code, the pitch lag code, and the control signal on the narrow bandwidth channel;

(p) if the control signal indicates that the spike signal is to be used, then transmitting the spike gain code and the spike signal code on the narrow bandwidth channel;

(q) if the control signal indicates that the spike signal is not to be used, then transmitting the innovation gain code and the innovation signal code on the narrow bandwidth channel; and (r) repeating steps (d) through (q) until the speech stops.

2. A method for receiving digitized speech from a narrow bandwidth channel, the method comprising the steps of:

(a) receiving a tap weight code, a pitch gain code, a pitch lag code, and a control signal from the narrow bandwidth channel;

(b) if the control signal indicates that a spike signal is to be used, then:

(1) receiving a spike gain code and a spike signal code from the narrow bandwidth channel;

(2) reconstructing a spike signal from the spike signal code;

(3) reconstructing a spike gain from the spike gain code;

(4) multiplying the spike signal by the spike gain to produce a scaled spike signal; and (5) applying the scaled spike signal to a first input of a summer;

(c) if the control signal indicates that the spike signal is not to be used, then:

(1) receiving an innovation gain code and an innovation signal code from the narrow bandwidth channel;

(2) reconstructing an innovation signal from the innovation signal code;

(3) reconstructing an innovation gain from the innovation gain code;

(4) multiplying the innovation signal by the innovation gain to produce a scaled innovation signal; and (5) applying the scaled innovation signal to a first input of a summer;

(d) applying an output of the summer to a memory;

(e) receiving a pitch gain code and a pitch signal code from the narrow bandwidth channel;

(f) reconstructing a pitch signal from the pitch signal code and a previous output from the memory;

(g) reconstructing a pitch gain from the pitch gain code;

(h) multiplying the pitch signal by the pitch gain to produce a scaled pitch signal;

(i) reconstructing a plurality of tap weights from the tap weight code;

(j) applying the tap weights to a synthesis filter;

(k) applying the output of the summer to the synthesis filter to produce a digitized speech signal;

(l) undigitizing the digitized speech signal into analog electronic speech signal with a digital-to-analog converter;

(m) converting the analog electronic speech signal into an analog auditory signal; and (n) repeating steps (a) through (m) until the channel provides no further signals.

3. Apparatus for transmitting speech over a narrow bandwidth channel, comprising:

(a) means for converting speech from an analog auditory signal to an analog electronic signal;

(b) means for digitizing the electronic signal into digitized speech with an analog-to-digital converter;

(c) means for breaking the digitized speech into a plurality of frames;

(d) means for selecting a next frame and applying it to:

(1) a linear prediction coder to produce a plurality of tap weights and coding the tap weights to produce a tap weight code;

(2) a perceptual weighting filter set to the tap weights and constructed to produce, as an output, a digitized signal as it would be perceived by a human being; and (3) an analysis filter set to the tap weights and constructed to produce an LPC residual signal;

(e) means for receiving the output of the analysis filter at a first input of a spike minimizer, the spike minimizer producing:

(1) at a first output, a spike gain code which is applied to a spike gain element; and (2) at a second output, a spike signal code which is applied to a spike codebook; the spike gain element and the spike codebook being connected to jointly produce a scaled spike, the scaled spike being applied to a second input of the spike minimizer; and the spike minimizer generating a spike gain code and a spike signal code which minimize an error between the scaled spike and the analysis filter output;

(f) means for receiving the scaled spike at a spike synthesis filter and perceptual weighting filter set to the tap weights, the spike synthesis filter and perceptual weighting filter producing an output;

(g) means for receiving the output of the spike synthesis filter and perceptual weighting filter at a first input of a pitch minimizer, the pitch minimizer producing:

(1) at a first output, a pitch gain code which is applied to a pitch gain element; and (2) at a second output, a pitch lag code which is applied to a pitch lag element; the pitch gain element and the pitch lag being connected to jointly produce a scaled pitch signal from:

(A) the pitch gain code;

(B) the pitch lag code; and (C) a previous output of a memory; the scaled pitch signal being applied to a pitch synthesis filter and perceptual weighting filter set to the tap weights, and the pitch synthesis filter and perceptual weighting filter producing an output which is applied to a second input of the pitch minimizer;

(h) means for generating, in the pitch minimizer, a pitch gain code and a pitch lag code which minimizes an error between:

(1) the perceptual weighting filter output;

(2) the spike synthesis filter and perceptual weighting filter output; and (3) the pitch synthesis filter and perceptual weighting filter output;

(i) means for receiving the output of the pitch synthesis filter and perceptual weighting filter at a first input of an innovation minimizer, the innovation minimizer producing:

(1) at a first output, an innovation gain code which is applied to an innovation gain element; and (2) at a second output, an innovation signal code which is applied to an innovation codebook; the innovation gain element and the innovation codebook being connected to jointly produce a scaled innovation signal, the scaled innovation signal being applied to an innovation synthesis filter and perceptual weighting filter producing an output which is applied to a second input of the innovation minimizer;

(j) means for summing the scaled innovation signal with the scaled pitch signal in a summer to produce a scaled overall signal;

(k) means for storing the scaled overall signal in the memory;

(l) means for generating, in the innovation minimizer, an innovation gain code and an innovation signal code which minimize an error between:

(1) the perceptual weighting filter output;

(2) the spike synthesis filter and perceptual weighting filter output;

(3) the pitch synthesis filter and perceptual weighting filter output; and (4) the innovation synthesis filter and perceptual weighting filter output;

(m) means for generating, in the innovation minimizer, a control signal indicating whether or not a spike signal is to be used at a receiving end;

(n) means for applying the control signal to the pitch minimizer to cause it to use the spike synthesis filter and perceptual weighting filter output, but only if the control signal indicates that the spike signal is to be used at the receiving end;

(o) means for transmitting the tap weight code, the pitch gain code, the pitch lag code, and the control signal;

(p) means, responsive if the control signal indicates that the spike signal is to be used, for transmitting the spike gain code and the spike signal code;

(q) means, responsive if the control signal indicates that the spike signal is not to be used, for transmitting the innovation gain code and the innovation signal code; and (r) means for repeating the operation of the apparatus described in (d) through (q) until the speech stops.

4. Apparatus for receiving digitized speech from a narrow bandwidth channel, comprising:

(a) means for receiving a tap weight code, a pitch gain code, a pitch lag code, and a control signal from the narrow bandwidth channel;

(b) means, responsive if the control signal indicates that a spike signal is to be used, for:

(1) receiving a spike gain code and a spike signal code from the narrow bandwidth channel;

(2) reconstructing a spike signal from the spike signal code;

(3) reconstructing a spike gain from the spike gain code;

(4) multiplying the spike signal by the spike gain to produce a scaled spike signal; and (5) applying the scaled spike signal to a first input of a summer;

(c) means, responsive if the control signal indicates that the spike signal is not to be used, for:

(1) receiving an innovation gain code and an innovation signal code from the narrow bandwidth channel;

(2) reconstructing an innovation signal from the innovation signal code;

(3) reconstructing an innovation gain from the innovation gain code;

(4) multiplying the innovation signal by the innovation gain to produce a scaled innovation signal; and (5) applying the scaled innovation signal to a first input of a summer;

(d) means for applying an output of the summer to a memory;

(e) means for receiving a pitch gain code and a pitch signal code from the narrow bandwidth channel;

(f) means for reconstructing a pitch signal from the pitch signal code and a previous output from the memory;

(g) means for reconstructing a pitch gain from the pitch gain code;

(h) means for multiplying the pitch signal by the pitch gain to produce a scaled pitch signal;

(i) means for reconstructing a plurality of tap weights from the tap weight code;

(j) means for applying the tap weights to a synthesis filter;

(k) means for applying the output of the summer to the synthesis filter to produce a digitized speech signal;

(l) means for undigitizing the digitized speech signal into analog electronic speech signal with a digital-to-analog converter;

(m) means for converting the analog electronic speech signal into an analog auditory signal; and (n) means for repeating the operation of the apparatus described in (a) through (m) until the channel provides no further signals.

* * * * *